US006132185A

United States Patent [19]

Wilhelm

[11] Patent Number: 6,132,185

[45] Date of Patent: Oct. 17, 2000

[54] FEED PUMP

[75] Inventor: Dieter Wilhelm, Neu Anspach, Germany

[73] Assignee: Mannesmann Vdo AG, Germany

[21] Appl. No.: 09/333,460

[22] Filed: Jun. 15, 1999

[30] Foreign Application Priority Data

Jun. 17, 1998 [DE] Germany ..... 198 26 902

[51] Int. Cl.[7] ..... F04B 17/00

[52] U.S. Cl. ..... 417/423.15; 415/55.1

[58] Field of Search ..... 417/423.15, 423.14; 415/55.1, 55.2, 55.3, 55.4; 416/203

[56] References Cited

U.S. PATENT DOCUMENTS 4,258,726 3/1981 Glaser et al. ..... 460/109
5,380,149 1/1995 Valsamidis ..... 415/2.1
5,549,446 8/1996 Gaston et al. ..... 415/55.1
5,618,160 4/1997 Harada et al. ..... 415/17
5,713,730 2/1998 Nose et al. ..... 417/423.12
5,851,103 12/1998 Harada et al. ..... 415/17

*Primary Examiner*—Teresa Walberg
*Assistant Examiner*—Vinod D. Patel
*Attorney, Agent, or Firm*—Mayer Brown & Platt

[57] ABSTRACT

In a feed pump (2) designed as a peripheral or side channel pump, guide vanes (9, 11, 12) arranged in an impeller (4) have a different angle of inclination in the radially inner region from the radially outer region. As a result, the characteristic curve of the feed pump (2) can be modified simply by exchanging the impeller (4). By virtue of the invention, the feed pump (2), whilst having an intended feed pressure and volume flow, can be set to particularly high efficiency, depending on the viscosity of the liquid to be fed.

6 Claims, 2 Drawing Sheets

FEED PUMP

BACKGROUND OF THE INVENTION

The invention relates to a feed pump with a driven impeller which rotates in a pump casing and in which a ring of guide vanes delimiting vane chambers is arranged in at least one of the end faces of said impeller, and with a part-annular channel which is arranged in the pump casing in the region of the guide vanes and which forms, with the vane chambers, a feed chamber for feeding a liquid from an inlet channel to an outlet channel.

Such feed pumps are known as peripheral or side channel pumps and are used, for example, in present-day motor vehicles for feeding fuel or washing fluid. When the impeller rotates, the guide vanes generate, in the feed chamber, a circulation flow running transversely to the direction of movement of the guide vanes. The guide vanes form, in the radially inner region of the impeller, the region of entry of the circulation flow into the vane chambers and, in the radially outer region, the exit region of said circulation flow. In order to adapt the feed pump to an intended characteristic curve and to the viscosity of the liquid to be fed, the angle of inclination of the guide vanes and the chamber volume can be calculated and adapted. This adaptation is critical for the efficiency of the feed pump in the intended instance of use.

A disadvantage of the known feed pump is that the dimensioning of the angle of inclination of the guide vanes may represent merely a compromise, because the conditions during the entry and exit of the circulation flow and therefore also the turbulence and frictional losses are different. These frictional losses and turbulences considerably reduce the efficiency of the feed pump.

SUMMARY OF THE INVENTION

The problem on which the invention is based is to design a feed pump of the type initially mentioned, in such a way that, whilst having an intended characteristic curve, its efficiency is as high as possible.

This problem is solved, according to the invention, in that the guide vanes have a different angle of inclination in the radially inner region of the impeller than in the radially outer region of the impeller.

By virtue of this design, the characteristic curve of the feed pump according to the invention can be adapted to the intended instance of use simply by exchanging the impeller. On account of the invention, frictional losses on the guide vanes or very low acceleration of the circulation flow within the vane chambers can be reduced to a minimum, using an impeller with corresponding angles of inclination. It is possible, as a result, to assemble feed pumps for different instances of use and characteristic curves so as to have particularly high efficiency.

The feed pump according to the invention has particularly high efficiency, along with high volume flows and a constant feed pressure, if the angle of inclination of the guide vanes in relation to the perpendicular to the end face of the impeller is larger in the radially inner region than in the radially outer region. This design gives rise, in the entry region of the vane chamber, to particularly low turbulences and frictional losses in the circulation flow. The circulation flow is greatly accelerated in the exit region. The feed pump according to the invention is consequently suitable, in particular, for use as an electrically driven fuel pump in a motor vehicle.

Another possibility of adapting the characteristic curve of the feed pump according to the invention is for the radially inner and outer regions of the guide vanes to have a tangential offset on the end face of the impeller. In this case, the tangential offset may be continuous or discontinuous.

According to another advantageous development of the invention, the entry and exit regions of the vane chambers can be separated from one another, if the impeller has a peripheral rim on its end face in the middle region of the guide vanes. Turbulences within the circulation flow are thereby avoided. This leads to a further increase in the efficiency of the feed pump according to the invention.

According to another advantageous development of the invention, the impeller can be manufactured particularly cost-effectively if it has two wheel bodies arranged one above the other in the manner of a sandwich. The wheel body having the different angles of inclination of the guide vanes can thereby be compression-moulded or injection-moulded by means of a two-part mould in the same way as the impeller of the known feed pump.

According to another advantageous development of the invention, the wheel bodies are permanently connected to one another, such as adhesively bonded or welded to one another.

BRIEF DESCRIPTION OF THE DRAWINGS

The invention permits numerous embodiments. To make its basic principle even clearer, one of these is illustrated in the drawing and is described below. In the drawing.

DETAILED DESCRIPTION OF THE PREFERRED EMBODIMENTS

Figure 1:
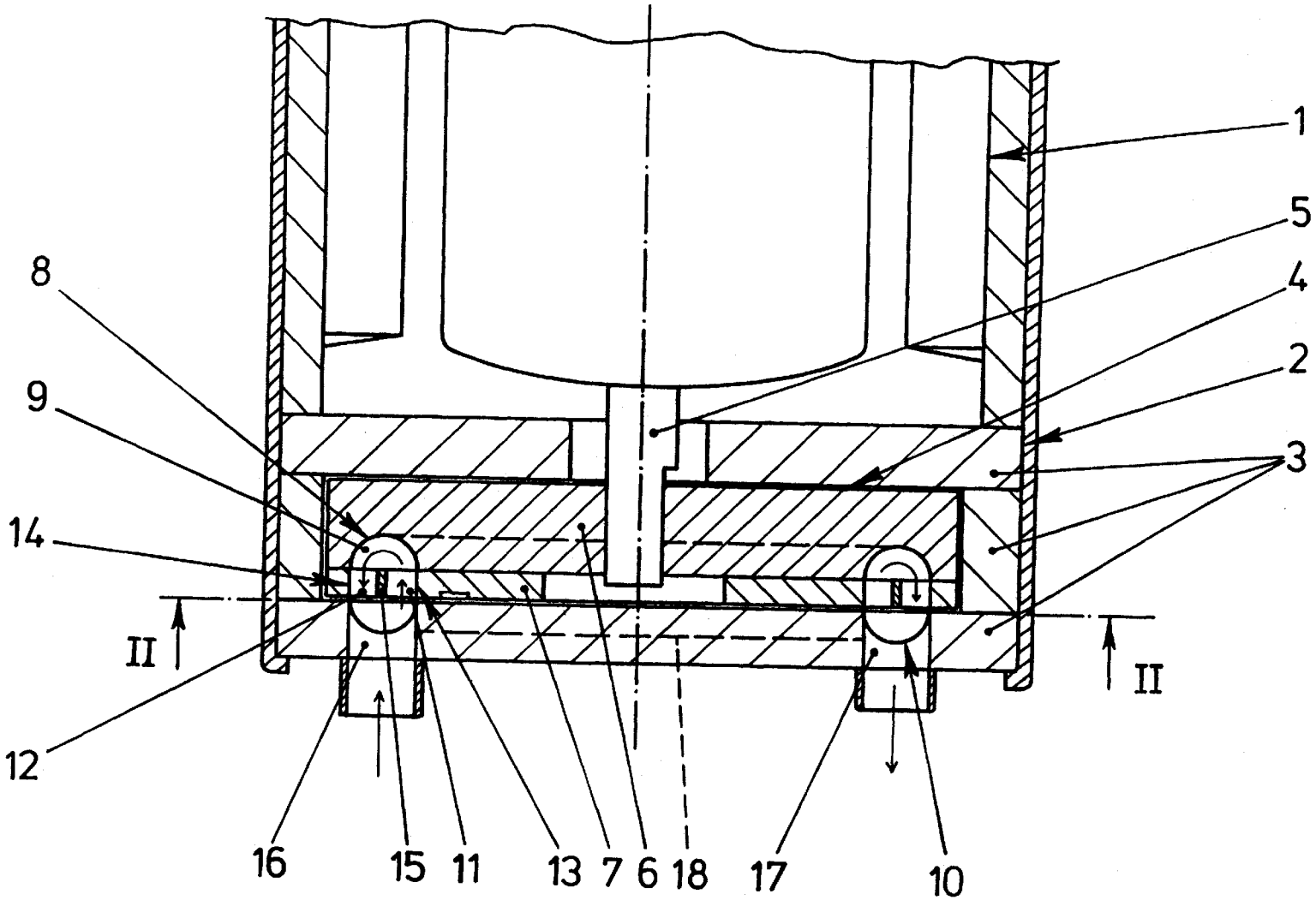
FIG. 1 shows a feed pump according to the invention in longitudinal section.

FIG. 1 shows a feed pump 2 according to the invention, driven by an electric motor 1, in longitudinal section. The feed pump 2 has an impeller 4 arranged rotatably in a casing 3, with a first wheel body 6 fastened on a shaft 5 of the electric motor 1 and with a second wheel body 7 adhesively bonded to said first wheel body. The first wheel body 6 has a ring of guide vanes 9 delimiting vane chambers 8. The second wheel body 7 has a ring of radially inner guide vanes 11 and a ring of radially outer guide vanes 12. As a result, vane chambers 13, 14 pass through the second wheel body 7. The guide vanes 11, 12 of the second wheel body 7 are separated from one another by a peripheral rim 15. In the region located opposite the guide vanes 11, 12, the casing 3 has a part-annular channel 18 extending from an inlet channel 16 to an outlet channel 17. The vane chambers 8, 13, 14 and the part-annular channel 18 form a feed chamber 10 for the liquid to be fed.

When the impeller 4 rotates, a circulation flow occurs in the feed chamber 10. The liquid to be fed is led from the inlet channel 16 first through the radially inner vane chambers 13 of the second wheel body 7 into the vane chambers 8 of the first wheel body 6. The liquid subsequently passes via the radially outer vane chambers 14 of the second wheel body 7 into the part-annular channel 18. While the liquid passes through the vane chambers 8, 13, 14 of the impeller 4, the circulation flow experiences an increase in its kinetic energy. To make this clearer, the flows of the liquid within the feed pump 2 are identified by arrows.

Figure 2:
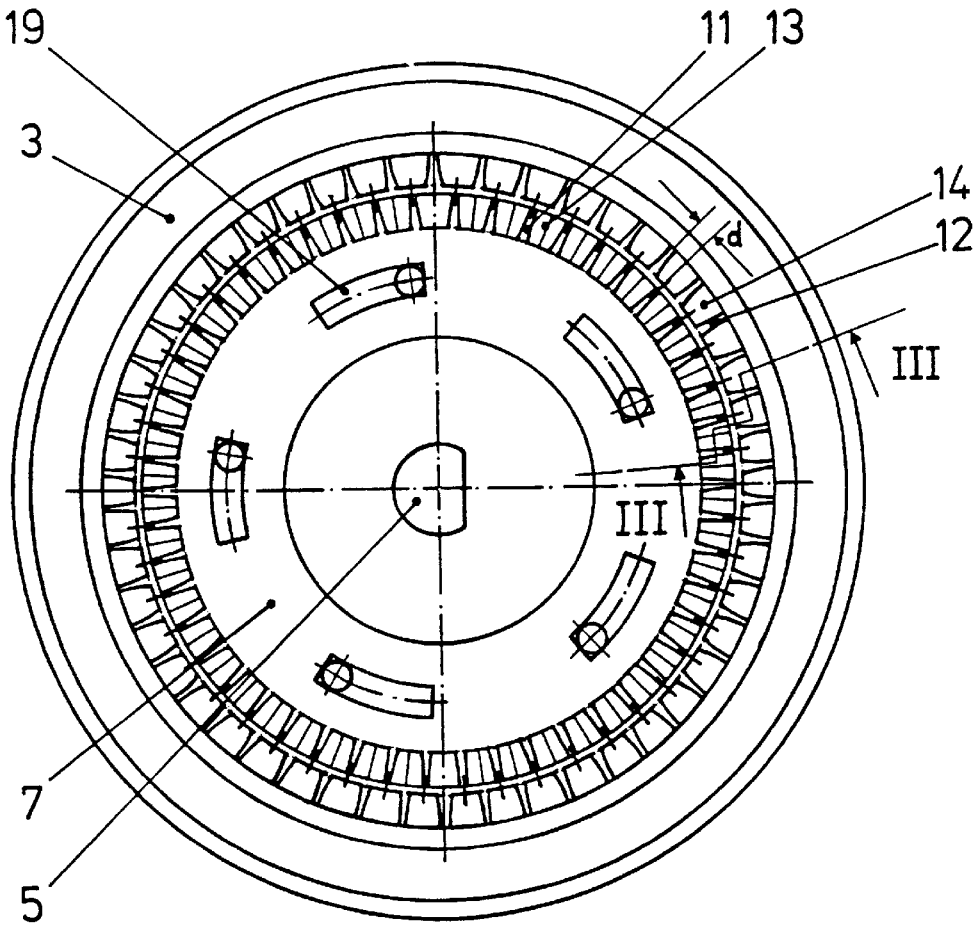
FIG. 2 shows a sectional illustration through the feed pump of FIG. 1 along the line II—II.

FIG. 2 shows the end face of the second wheel body 7 in a sectional illustration through the feed pump 2 of FIG. 1 along the line II—II. It can be seen, here, that the radially inner guide vanes 11 have a tangential offset d in relation to the radially outer guide vanes 12. Furthermore, the second wheel body 7 has, in a radially middle region, pockets 19 for the liquid to be fed. These pockets 19 form an axial sliding bearing for the impeller 4.

Figure 3:
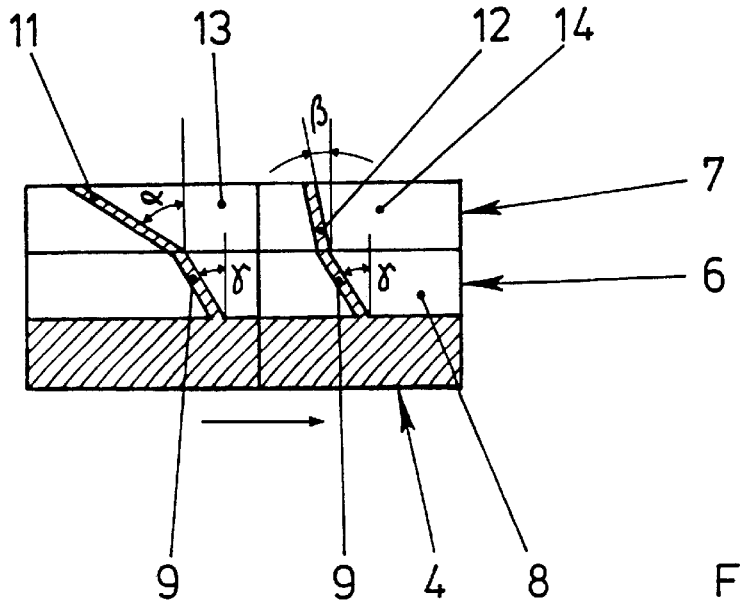
FIG. 3 shows a sectional illustration through guide vanes of an impeller of FIG. 2 along the line III—III.

FIG. 3 shows angles of inclination α, β, γ of the guide vanes 9, 11, 12 in relation to the perpendicular to the end face of the impeller 4 in a section through the vane chambers 8, 13, 14 of the impeller 4 along the line III—III. The radially inner guide vanes 11 of the second wheel body 7 have a large angle of inclination α, so that the circulation flow experiences only low frictional loss at this point. The radially outer guide vanes 12 have a small angle of inclination β, so that the circulation flow experiences a very great increase in its kinetic energy. The guide vanes 9 of the first wheel body 6 have the same angle of inclination γ in each case in the radially inner and the radially outer region.

The characteristic curve of the feed pump 2 according to the invention is therefore determined to a very great extent by the offset d and the angles of inclination α, β, γ of the guide vanes 9, 11, 12. The feed pump 2 can consequently be adapted to its respective instance of use, simply by exchanging the impeller 4.

What is claimed is:

1. A feed pump with a driven impeller which rotates in a pump casing and in which a ring of guide vanes delimiting vane chambers is arranged in at least one of the end faces of said impeller, and with a part-annular channel which is arranged in the pump casing in the region of the guide vanes and which forms, with the vane chambers, a feed chamber for feeding a liquid from an inlet channel to an outlet channel, wherein the guide vanes (11, 12) have a different angle of inclination (α, β) in the radially inner region of the impeller (4) than in the radially outer region of the impeller (4).

2. The feed pump as claimed in claim 1, wherein the angle of inclination (α, β) of the guide vanes (11, 12) in relation to the perpendicular to the end face of the impeller (4) is larger in the radially inner region than in the radially outer region.

3. The feed pump as claimed in claim 1, wherein the radially inner and outer regions of the guide vanes (11, 12) have a tangential offset (d) on the end face of the impeller (4).

4. The feed pump as claimed in claim 1, wherein the impeller (4) has a peripheral rim (15) on its end face in the middle region of the guide vanes (11, 12).

5. The feed pump as claimed in claim 1, wherein the impeller (4) has two wheel bodies (6, 7) arranged one above the other in the manner of a sandwich.

6. The feed pump as claimed in claim 5, wherein the wheel bodies (6, 7) are adhesively bonded or welded to one another.

* * * * *